US005827123A

United States Patent [19]

Reverchon

[11] Patent Number: 5,827,123

[45] Date of Patent: Oct. 27, 1998

[54] CAROUSEL FOR CARNIVALS AND AMUSEMENT PARKS

[75] Inventor: Gilles Reverchon, Samois, France

[73] Assignee: Gaston Reverchon Industries, Paris, France

[21] Appl. No.: 762,059

[22] Filed: Dec. 9, 1996

[30] Foreign Application Priority Data

Dec. 8, 1995 [FR] France ..... 95 14535

[51] Int. Cl.[6] ..... A63G 1/48

[52] U.S. Cl. ..... 472/43

[58] Field of Search ..... 472/29, 36, 43, 472/37, 38, 31, 59; 104/77, 78, 74, 75

[56] References Cited

U.S. PATENT DOCUMENTS 2,165,698 7/1939 Eyerly .

FOREIGN PATENT DOCUMENTS 392329 11/1908 France .

547630 12/1922 France .

90 02 880.5 8/1991 Germany .

92 10 125.9 6/1993 Germany .

19586 of 1912 United Kingdom .

*Primary Examiner*—Kien T. Nguyen

*Attorney, Agent, or Firm*—Young & Thompson

[57] ABSTRACT

A carousel for carnivals and amusement parks of the type comprising a loading and unloading station (10) for passengers in vehicles moving about the path of a tubular railway (1) defining curves, ups and downs. Each vehicle (2) comprises a rolling platform (3) and a nacelle (4) accommodating the passengers, the nacelle (4) being constituted by a passenger compartment independent of the rolling platform (3) and being mounted pivotally on the rolling platform (3). The vehicle (2) has structure adapted to limit the pivoting of the nacelle (4) and to return it toward a stable forward position with the passengers facing in the direction of movement of the vehicle (2).

18 Claims, 7 Drawing Sheets

CAROUSEL FOR CARNIVALS AND AMUSEMENT PARKS

This application corresponds to French application 95 14535 of Dec. 8, 1995, the disclosure of which is incorporated herein by reference.

The present invention relates to a carousel for carnivals and amusement parks of the type of carousels such as Russian mountains, figure 8 or roller coasters.

This type of carousel comprises a circuit with curves and ups and downs and on which moves at least one vehicle transporting passengers guided on the rails of a railway.

Conventional vehicles ordinarily comprise a passenger compartment mounted on a platform provided with wheels permitting movement of the vehicle on the rails. The passenger compartment, accommodating most often two passengers, is in general fixed relative to said platform and the vehicles are articulated to each other in the form of a train. There also exist vehicles with more than two seats in which the passengers are most often disposed two by two behind each other.

The railway circuit defined in this type of carousel permits giving multiple thrills to the passengers in accordance with the speed of the vehicles around the curves, the ups and downs provided along the path as well as the abrupt speed changes arising from these changes in the path.

Professionals in carnivals and amusement parks being endlessly searching for new carousels giving new thrills so as to maintain the interest of the public, carousels have appeared of the type in which the passenger compartment is mounted pivotally on the platform.

Thus, German utility models DE-U-9 002 880 and DE-U-9 210 125 disclose carousels of this type in which nacelles accommodating passengers are mounted pivotally on a platform movable on rails.

At the outset and along straight stretches of the path of the carousel, the nacelle is in a so-called forward position, which is to say that the passengers face the direction of movement of the vehicle defined by the path. Eccentricity of the weight of the nacelle permits actuating pivoting of said nacelle relative to the rolling platform in the course of movement of this latter over the path of the carousel, in particular during movement about curves, there is thus given to the passengers new thrills connected both to the forward movement of the vehicle and to the pivoting of the nacelle.

However, in this type of carousel, the free permanent rotation of the nacelle can give rise to undesirable dizziness of the passengers because of the substantially continuous pivoting of the nacelle.

Moreover, the pivoting also has the result that the nacelle, when the vehicle is moving along a straight stretch of the carousel, which is to say when said nacelle is no longer subject to eccentric loading, then keeps a substantially stable position which does not always correspond to the forward position of the nacelle and which can be uncomfortable to the passengers not only in travel but also when debarking.

So as to overcome these drawbacks, the present invention provides a carousel comprising a circuit of the Russian mountain type or figure 8 in which the vehicle moving along the path has a construction such that in addition to the movement of the vehicle about the path there will be an added or supplemental movement of the vehicle itself along the path, said carousel comprising moreover means to control said supplemental movement of the vehicle so as to permit bringing it to a stable position.

To this end, the invention has for its object a carousel for carnivals and amusement parks of the type comprising a loading and unloading station for passengers of vehicles moving about the path of a tubular railway defining curves, ups and downs, said vehicles being constituted of a rolling platform and a nacelle accommodating the passengers, the nacelle being constituted of a passenger compartment independent of the rolling platform and being mounted pivotally on said rolling platform, characterized in that the vehicle comprises means to limit the pivoting of the nacelle and to return it toward a stable forward position, the passengers being in the direction of movement of the vehicle.

Thus, the nacelle, mounted on the platform by means of a pivot whose axis is orthogonal to said rolling platform, is pivotally driven under the influence of the eccentric weight of the nacelle, said pivoting being limited, preferably by braking it, so as to be able to return the nacelle toward a stable position corresponding to the forward position.

Preferably, said means are constituted by a cam driven pivotally with the nacelle, a shock absorber such as a pad, coacting with the cam so as to limit the speed of said cam driven pivotally and a lever provided with a roller coacting with the profile of the cam, said lever and shock absorber being mounted on the platform to exert on the cam equal and opposite forces, the cam profile being such as to permit the blocking of the pivoting and the return of the nacelle toward at least a stable position corresponding to the forward position.

Thus, there is created, in the course of the movement of the vehicle along the path defined by the railway, a pivoting movement of the nacelle independent of the movement of said rolling platform, this movement being preferably controlled by the presence of said cam, of the lever provided with a roller and of the shock absorber. There is thus limited any risk of dizziness and discomfort for the passengers.

Preferably, the shock absorber such as a pad exerts a force along the profile of the cam so as to limit the speed of pivoting of the nacelle, the lever provided with a roller permitting applying an equal but opposite force to the force exerted by the shock absorber to return the nacelle toward a stable forward position, the profile of the cam being such as specifically to promote the positioning of the nacelle in said stable position.

According to a first modification, this cam has a stable position in which the nacelle is in forward position, the passengers thus facing in the direction of forward movement of the vehicle.

According to a second modification, the cam can have two stable positions, one corresponding to the nacelle in the forward position (passengers facing in the direction of movement of the vehicle) and the other corresponding to the nacelle in the rear position (passengers facing in the direction opposite the movement of the vehicle).

Thus, the nacelle takes a forward position or a forward or rearward position relative to the rolling platform.

Preferably, there is provided at the entry of the loading and unloading platform, means to control the placing in forward position of the nacelle when the latter is in the rear position or has pivoted.

According to a supplemental characteristic of the invention, it is possible to provide means for locking and unlocking the pivoting of the nacelle relative to the rolling platform.

Thus, because the nacelle is always returned toward a stable position because of the presence of the control means of pivoting of the nacelle, it is possible, when the nacelle is in a stable position, to lock the pivoting of said nacelle, for example to debark, to move about a more dangerous portion of the carousel or to embark in the vehicle and to proceed to unlock the pivoting of the nacelle along selected portions of the path.

As a result, there is provided locking and unlocking means permitting blocking and freeing the pivoting of the nacelle along the path.

Thus, when a vehicle leaves the station after taking on passengers, the pivoting of the nacelle being blocked, this pivoting is unlocked at a predetermined place whilst at least at the entry of the station before embarking, the pivoting of the nacelle is again locked, the nacelle being returned to its forward position, to permit unloading passengers.

Preferably, the nacelle of the carousel according to the invention has a passenger compartment of substantially circular shape and comprises four front seats for the passengers.

So as to ensure safety of the passengers in the carousel, the nacelle comprises a safety bar swingable from an upper position above the heads of the passengers to a lower position substantially at the level of the passengers' waist, to keep them seated on the seats of the nacelle during rising and falling of the vehicle. This safety bar is provided with an anti-return valve jack mechanism thus preventing untimely raising of the bar for the entire length of the path.

So as to permit raising of the safety bar when the passengers debark, the station comprises, at its entry, a control ramp for opening the anti-return valve jack mechanism of said safety bar. Thus, in a preferred embodiment, the actuation of opening of this bar can take place only when the vehicle is in the station, thereby ensuring complete safety for the passengers along the path.

So as to permit easy rising and falling of the vehicle, the nacelle comprises a hand rail in the forward portion of the floor of the nacelle. It is thus possible for passengers to hold on to the hand rail during loading and unloading, then to take their place as well as to sit down and stand up. Because of this, it is possible to avoid complete stopping of the carousel in the loading and unloading station, the vehicles being able to move through the station at low speed thereby permitting passengers to stand up and sit down without having to stop the vehicles completely.

According to a preferred embodiment of the invention, the carousel is made entirely removable and transportable and, because of this, the station can be in the form of a container block comprising access ramps to the vehicles, roofs, canopies and guard rails. All these elements can in particular be in the form of foldable walls of the container block. Preferably, this block can also contain the operating mechanism of the carousel. It is then easy to disassemble said station relative to the path and to transport it in the form of a unitary block toward another utilization site.

Likewise, the facade of the carousel is preferably constituted by a beam integrated into the path defined by the railway and which also forms a unitary block in which is disposed a large part of the lights of the carousel, as well as the accessories such as the signage, the advertising panels, etc. Thus, in the course of disassembling and transporting the carousel, the beam constitutes a unitary block in which there is no need to disconnect and disassemble all the accessories.

There will now be described a preferred embodiment of the invention with reference to the drawings, in which.

Figure 4A:
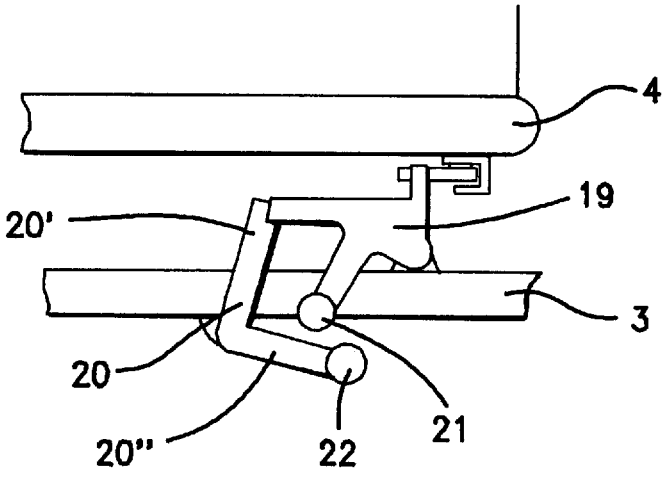
Figure 4B:
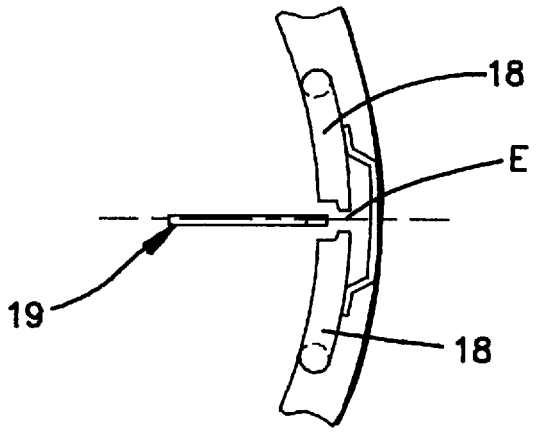
Figure 5A:
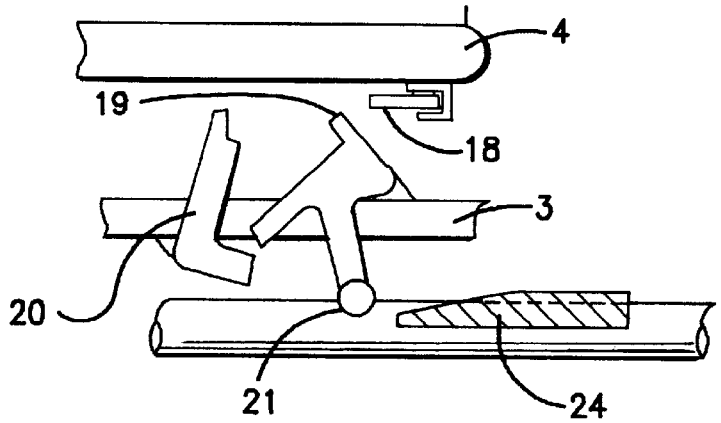
Figure 6A:
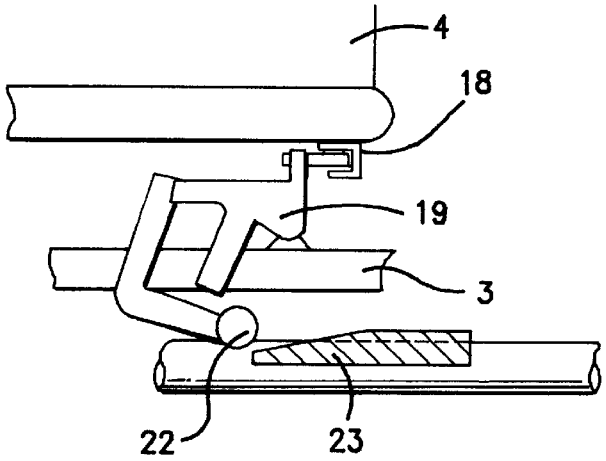
Figure 6B:
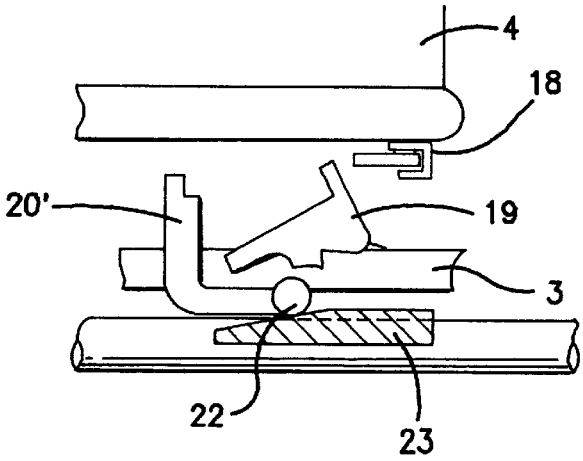
Figure 6C:
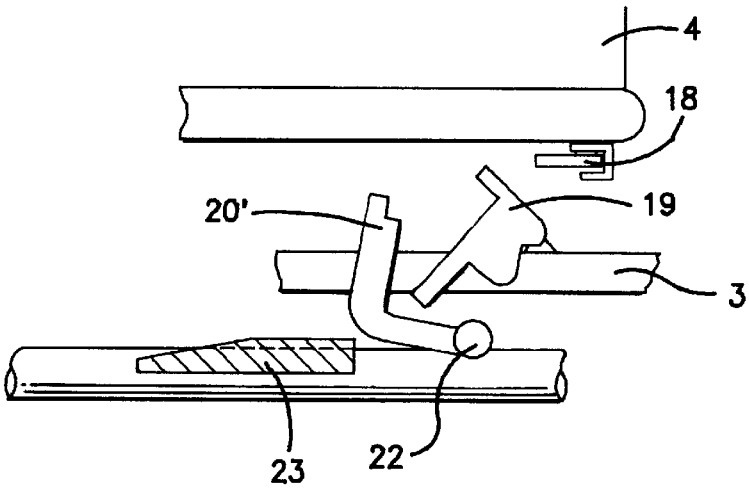
Figure 7:
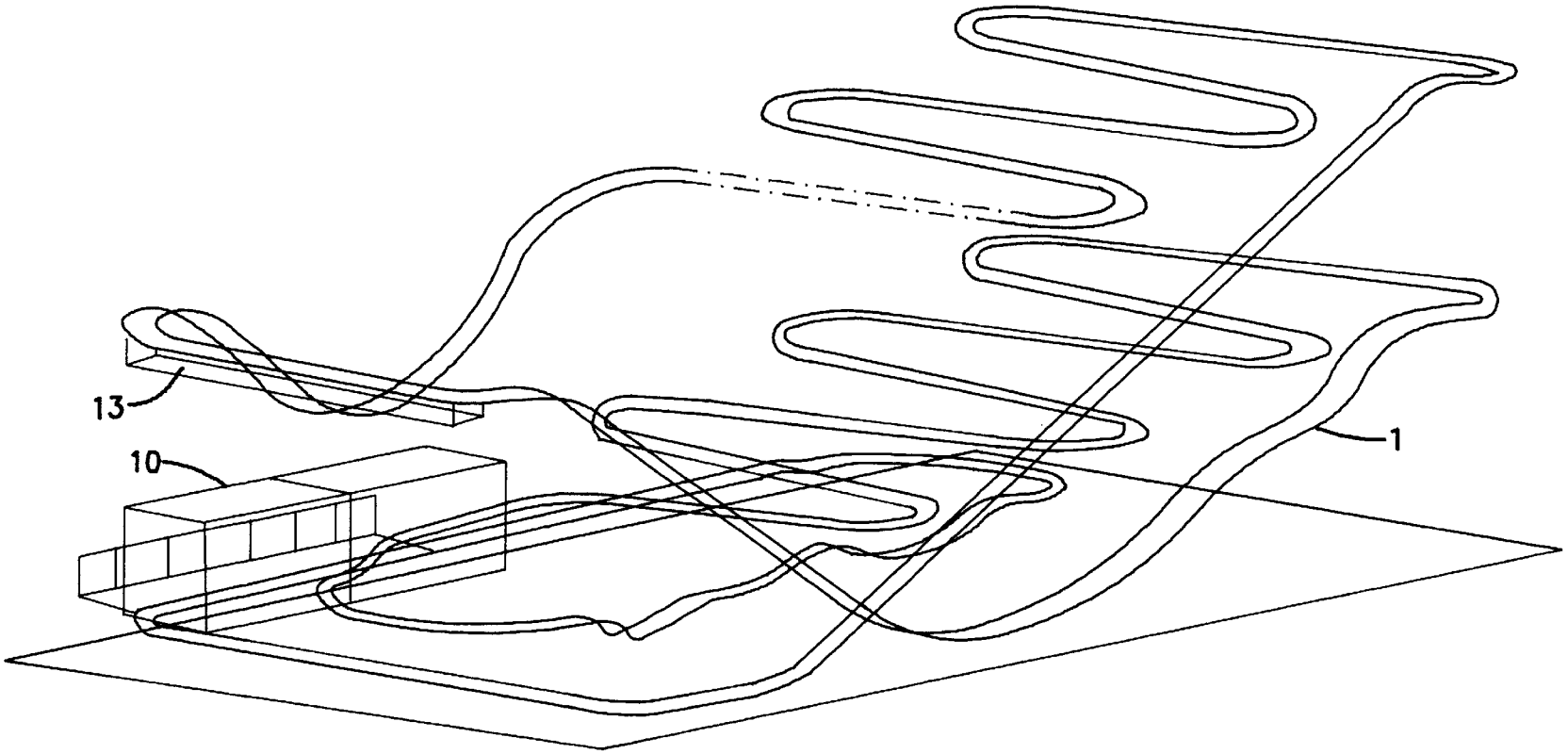
Figure 8:
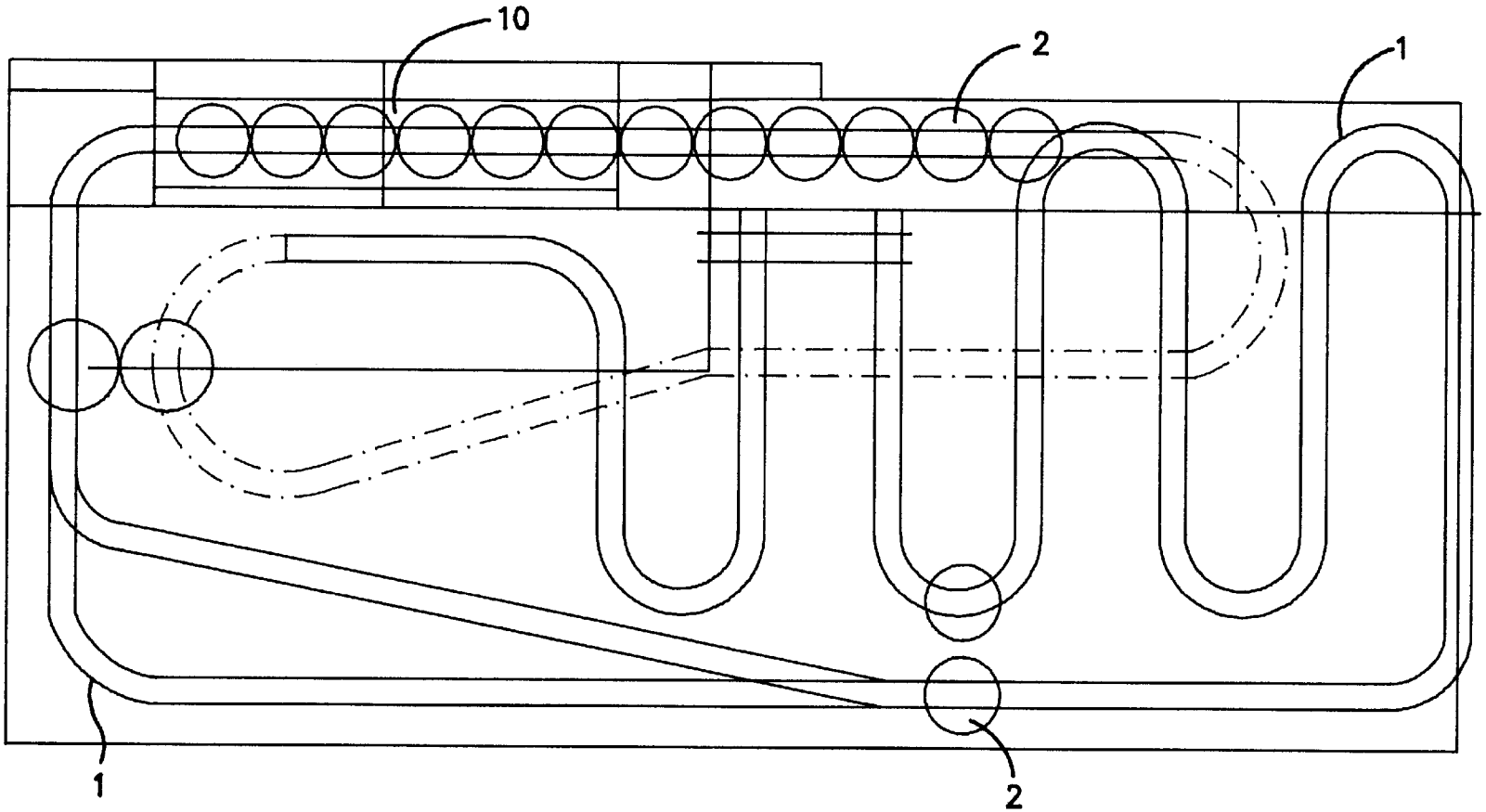

FIGS. 4*a* and 4*b* show schematically respectively a top plan view and a side cross-sectional view of the locking/unlocking means according to the invention;

FIGS. 5*a,* 5*b* and 5*c* show the actuation of unlocking the locking/unlocking means;

FIGS. 6*a,* 6*b* and 6*c* show the actuation of locking of the locking/unlocking means;

FIG. 7 is a schematic perspective view of the path of a carousel according to the invention; and FIG. 8 is a schematic plan view of a carousel according to the invention.

A carousel according to the invention comprises a tubular railway circuit 1 such as can be seen in FIG. 7 on which vehicles 2 circulate that accommodate passengers getting on and off at a station 10.

The vehicles 2 are constituted by a platform 3 and a nacelle 4 mounted pivotally on said platform 3 by means of a pivot 5 whose axis is orthogonal to said rolling platform 3.

The platform 3 circulates along the tubular railway 1 with guidance in all directions. It is thus provided with carrying wheels 6, side wheels 7 and anti-lifting wheels 8.

Figure 2:
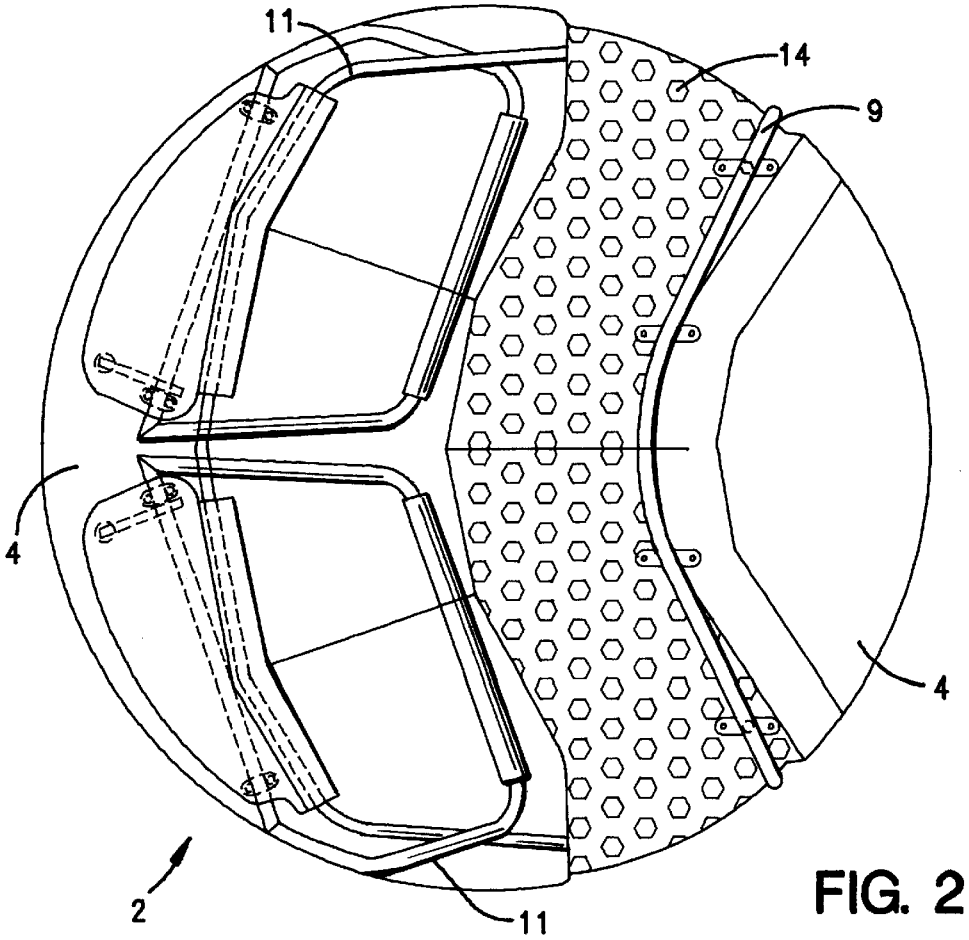
FIG. 2 is a top plan view of the nacelle of FIG. 1.

Preferably, the nacelle 4 comprises four front seats for passengers and has a substantially circular shape seen from above (see FIG. 2).

Figure 3:
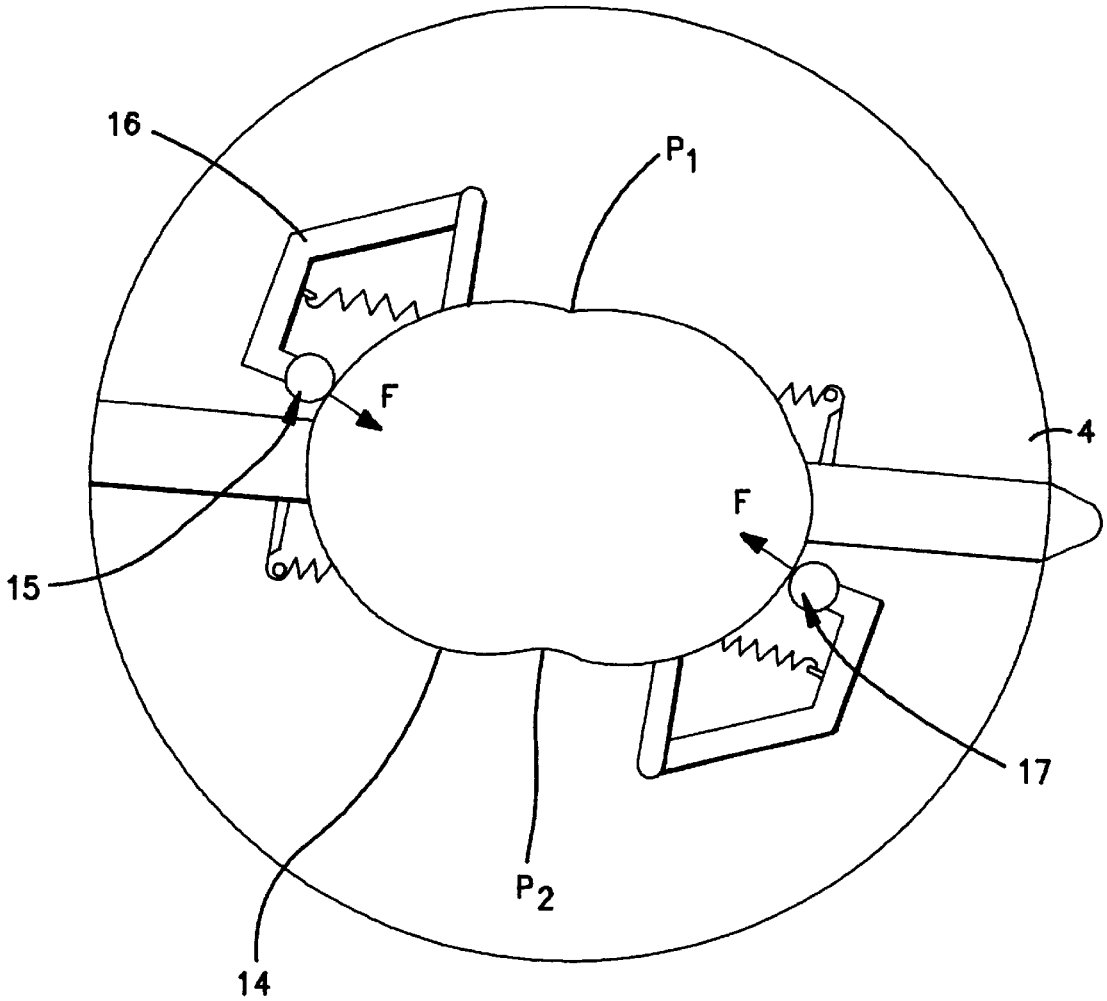
FIG. 3 is a cross-sectional view of the cam according to the second embodiment of the invention.

The vehicle 2 comprises a cam 14 mounted on the pivot 5 so as to be driven pivotally with the nacelle 4 and whose profile coacts with a roller 15 of a lever 16 mounted on the platform 3 and a shock absorber 7 also mounted on the platform 3. The shock absorber 17 and the lever 16 provided with a roller 15 are such as to exert on the profile of the cam 14 an equal force F and are disposed relative to each other such that the force F exerted by the lever 16 provided with the roller 15 is opposite to that exerted by the shock absorber 17, as is seen in FIG. 3.

The profile of the cam 14 comprises two dead points P1 and P2 which determine stable forward and rearward positions of the nacelle 4.

In the course of movement of the vehicle 2 on the carousel, the nacelle is driven pivotally relative to the platform 3 under the influence of eccentric weight of said nacelle 4. The shock absorber 17 exerts a braking on the profile of the cam 14 so as to limit the speed of pivoting of said nacelle. The roller 15 mounted on the lever 16 thus exerts a force opposite to the force exerted by the shock absorber 17 such that the cam 14 having a suitable profile, tends to cause blocking of the pivoting of the nacelle 4 into a stable position of the cam 14 corresponding to a forward position of the nacelle 4.

The carousel according to the invention moreover comprises locking and unlocking means for the pivoting of the nacelle 4 relative to the platform 3. These means are provided to lock the pivoting of the nacelle 4 at least when the latter is in a forward position.

Thus, there is provided on the lower surface of the nacelle 4, two abutment elements 18 defining between them a space E in which can engage a stop finger 19 mounted pivotally on the platform 3 and comprising a roller 21 at its end opposite the stop finger 19. Said stop finger 19 coacts with an elbowed lever 20 of which one end 20' is in engagement with the stop finger 19 so as to maintain the latter between the abutment elements 18 and whose other end 20" comprises a roller 22, said lever 20 being also mounted pivotally on the platform 3.

When the stop finger 19 is engaged between the two abutment elements 18, the pivoting of the nacelle 4 is blocked relative to the platform 3.

Figure 5B:
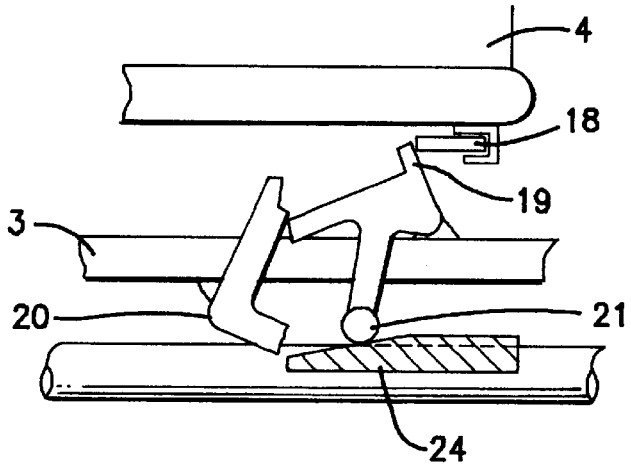
Figure 5C:
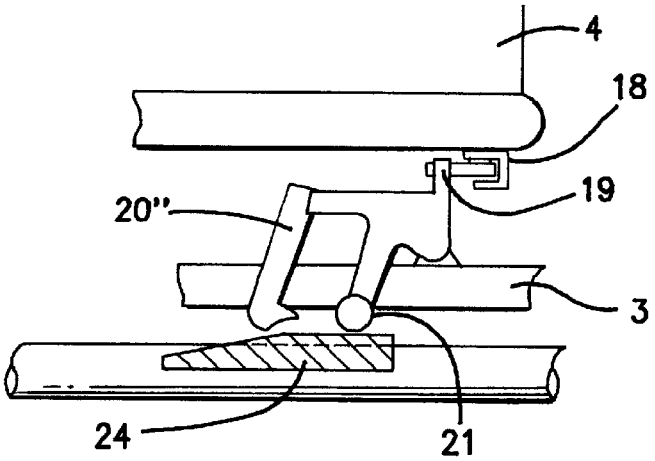

So as to unblock the stop finger 19, there is provided along the path a cam 23 having an inclined slope such that the roller 22 of the lever 20 following the inclined slope of said cam 23, drives pivotally said elbowed lever 20 which disengages from the stop finger 19 which swings rearwardly (FIG. 5*b*) and retreats between the abutment elements 18, freeing the pivoting of the nacelle 4.

This cam 23 can be provided at the beginning of the path of the exit of the station 10.

So as again to block the pivoting of the nacelle 4, for example during entry into the station for unloading, there is provided another cam 24 along the path. This cam 24 comprises an inclined slope such that the roller 21 of the stop finger 19 follows said inclined slope and swings such that the stop finger 19 is again engaged between the abutment elements 18, said stop finger 19 coacting again with the end 20" of the elbowed lever 20 which maintains it in the locking position.

It will be seen that this locking of the pivoting of the nacelle 4 is possible only if the nacelle 4 is in the forward position, which is to say that the abutment elements 18 provided on the nacelle 4 will be correctly positioned relative to the stop finger 19 provided on the platform 3.

When the cam 14 comprises two stable forward and rearward positions, the supplemental abutment elements can be provided such that the nacelle 4 can be blocked against pivoting in the rearward position.

Figure 1:
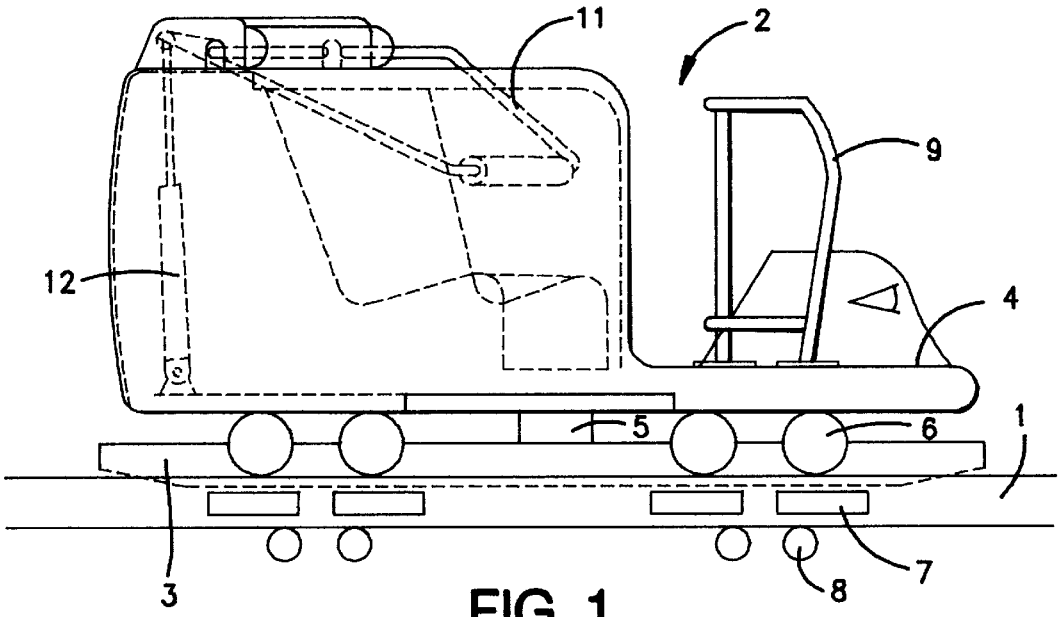
FIG. 1 is a side view partly in perspective of a nacelle of a carousel according to the invention.

Thus, as can be seen in FIG. 1, nacelle 4 comprises preferably a hand rail 9 fixed on the forward portion of its floor whilst a retractable safety bar 11 permits maintaining the passengers seated when they are seated in the nacelle 4. An anti-return valve jack 12 controls said security bar 11 and permits maintaining the latter in lowered position the full length of the carousel path from the start to return to the station. The station 10 is provided preferably with a control ramp for opening the safety valve actuating the opening of said mechanism 12 at the station entry once the trip is completed.

During passage toward the station 10, the vehicles 2 slow down prior to the entry. As the case may be, there is provided at the entry of the station 10, means suitable to control the forward position of the nacelle 4 when the latter is in the rearward position or has pivoted relative to the rolling platform 3. These means are disposed forwardly of the cam 24 which permits the locking of the pivoting of the nacelle 4 during its passage through the station 10, thereby facilitating the loading and unloading of passengers.

The safety bar 11 is then opened by the control ramp of the anti-return valve jack 12, provided also at the entry to the station 10.

The speed of the vehicle 2 is sufficiently low in the station 10 to permit the loading and unloading of passengers without the need to stop the vehicle 2. The speed of the vehicles 2 of the carousel being reduced in the station, several vehicles behind each other are present at the same time along the loading platform. So as to increase the accessibility of the passengers to the vehicles, the station 10 can comprise two storeys on which the vehicles 2 move.

A beam 13 of the circuit permits assembling together the lights of the carousel in the form of a block, thereby permitting easy handling during assembly, disassembly and transport of the carousel. Being located preferably in the facade of the carousel, this beam can comprise also other accessories such as a carousel sign.

The carousel according to the invention thus permits offering to the public new thrills different from those offered by carousels of the conventional figure 8 or Russian mountain types whilst ensuring complete safety of the public and offering also an easy assembly, disassembly and transport of the carousel.

What is claimed is:

1. In a carousel for carnivals and amusement parks comprising a loading and unloading station (10) for passengers in vehicles (2) moving about the path of a railway (1), said vehicles (2) being constituted by a rolling platform (3) and a nacelle (4) accommodating the passengers, the nacelle (4) being constituted by a passenger compartment independent of the rolling platform (3) and mounted pivotally on said rolling platform (3); the improvement wherein each said vehicles (2) comprises means adapted to limit the pivoting of the nacelle (4) and to return the nacelle toward a stable forward position with the passengers facing in the direction of movement of the vehicle (2).

2. Carousel according to claim 1, wherein said means comprise a cam (14) driven in rotation with the nacelle (4), a shock absorber (17) coacting with the cam (14) so as to limit the pivoting speed of the nacelle (4) and a lever (16) provided with a roller (15) coacting with a profile of the cam (14), said lever (16) and shock absorber (17) being mounted on the platform (3) to exert on the cam (14) equal and opposite forces (F), the profile of the cam (14) being such as to permit the blockage of the pivoting and the return of the nacelle (4) toward at least a stable position corresponding to the forward position.

3. Carousel according to claim 2, wherein the cam (14) has a stable position in which the nacelle (4) is in the forward position.

4. Carousel according to claim 2, wherein the cam (14) has two stable positions, one corresponding to the nacelle (4) in the forward position and the other corresponding to the nacelle (4) in the rearward position with the passengers facing in the opposite direction of movement of the vehicle (2).

5. Carousel according to claim 1, which further comprises locking and unlocking means of the pivoting of the nacelle (4) relative to the rolling platform (3).

6. Carousel according to claim 5, wherein said locking and unlocking means comprise an elbowed lever (20) mounted pivotally on the platform (3), a stop finger (19) mounted pivotally on the platform (3), two abutment elements (18) fixed on a lower surface of a forward side of the nacelle (4) and at least two cams (23, 24) fixed on said railway in the path of the nacelle (4), said abutment elements (18) providing between said abutment elements (18) a space (E) in which the stop finger (19) is engaged in the locking position, the elbowed lever (20) being in engagement with the stop finger (19) so as to maintain it in said locking position and being adapted to be driven pivotally by a first said cam (23) so as to free the stop finger (19) which pivots and retracts from between the two abutment elements (18) in the unlocking position, the stop finger (19) being adapted to be driven pivotally by the other said cam (24) so as to be reengaged between the abutment elements (18) and to be again in engagement with the elbowed lever (20).

7. Carousel according to claim 6, wherein the elbowed lever (20) comprises an end (20') provided with a roller (22) adapted to coact with said first cam (23) and an end (20") adapted to come into engagement with the stop finger (19).

8. Carousel according to claim 6, wherein the stop finger (19) comprises at one end a roller (21) adapted to coact with said other cam (24).

9. Carousel according to claim 1, wherein the nacelle (4) comprises four front passenger seats.

10. Carousel according to claim 1, wherein the nacelle comprises a hand rail in a forward portion of a floor (14) of the nacelle (4).

11. Carousel according to claim 1, wherein the platform (3) is provided with carrying wheels (6), lateral wheels (7) and hold-down wheels (8).

12. Carousel according to claim 1, wherein the nacelle (4) comprises a safety bar (11) lowerable from above the heads of the passengers and provided with an anti-return valve jack mechanism (12) preventing the raising of the bar (11) during travel.

13. Carousel according to claim 12, wherein the station (10) comprises a control ramp for opening the anti-return valve jack mechanism (12) of the safety bar (11) of the nacelle (4).

14. Carousel according to claim 1, which further comprises, at an entry to the station (10), means adapted to control forward positioning of the nacelle (4).

15. Carousel according to claim 1, wherein the vehicles (2) move through the station (10) at low speed permitting loading and unloading of the passengers without stopping.

16. Carousel according to claim 1, which further comprises at least one beam (13) forming a unitary block in which is disposed lighting of said carousel.

17. Carousel according to claim 1, wherein the station (10) is formed in a container block provided with access ramps, barriers, a roof, a canopy, as well as operating mechanisms.

18. Carousel according to claim 17, wherein the station (10) comprises two storeys for movement of the vehicles (2).

* * * * *